US005483410A

United States Patent [19]

Holmes et al.

[11] Patent Number: 5,483,410

[45] Date of Patent: Jan. 9, 1996

[54] ADVANCED DEGAUSSING COIL SYSTEM

[75] Inventors: John J. Holmes, Jessup, Md.; Shirley Steffey, Rochester, Mich.

[73] Assignee: The United States of America as represented by the Secretary of the Navy, Washington, D.C.

[21] Appl. No.: 217,908

[22] Filed: Mar. 25, 1994

[51] Int. Cl.[6] ..... B63G 9/00

[52] U.S. Cl. ..... 361/149; 102/402; 114/240 R

[58] Field of Search ..... 361/143, 146, 361/149, 267; 114/270, 240 R; 102/402; 307/101

[56] References Cited

U.S. PATENT DOCUMENTS

| | | | |
|---|---|---|---|
| 2,421,583 | 6/1947 | Stuart, Jr. | 114/240 |
| 2,519,395 | 8/1950 | Perlow et al. | 114/240 |
| 2,718,205 | 9/1955 | Gebs et al. | 114/240 |
| 2,730,063 | 1/1956 | Gebs et al. | 114/240 |
| 2,832,041 | 4/1958 | Trachtenberg | 324/43 |
| 2,853,040 | 9/1958 | Grillo | 114/240 |
| 2,891,502 | 6/1959 | Cochran, Jr. et al. | 114/240 |
| 2,933,059 | 4/1960 | Cohen et al. | 114/240 |
| 3,110,282 | 11/1963 | Foerster | 114/240 |
| 3,215,904 | 11/1965 | Burt | 361/149 |
| 4,186,681 | 2/1980 | Gish | 114/240 R |
| 4,676,168 | 6/1987 | Cotton | 102/402 |
| 4,734,816 | 3/1988 | Guillemin et al. | 361/149 |
| 5,189,590 | 2/1993 | Schneider | 361/149 |

*Primary Examiner*—Jeffrey A. Gaffin
*Attorney, Agent, or Firm*—Jacob Shuster

[57] ABSTRACT

The static magnetic field signature of a sea-going vessel is reduced by supply of degaussing current to pairs of loop coils adjacent to the port and starboard sides of the vessel hull. The coils of each pair are positioned at equal angles to a vertical plane extending longitudinally along the keel of the hull. The degaussing currents in the respective coils of each pair are simultaneously varied with respect to amplitude and polarity in accordance with geometrical heading of the vessel and changes in its roll and pitch orientations.

6 Claims, 1 Drawing Sheet

FIG. 1
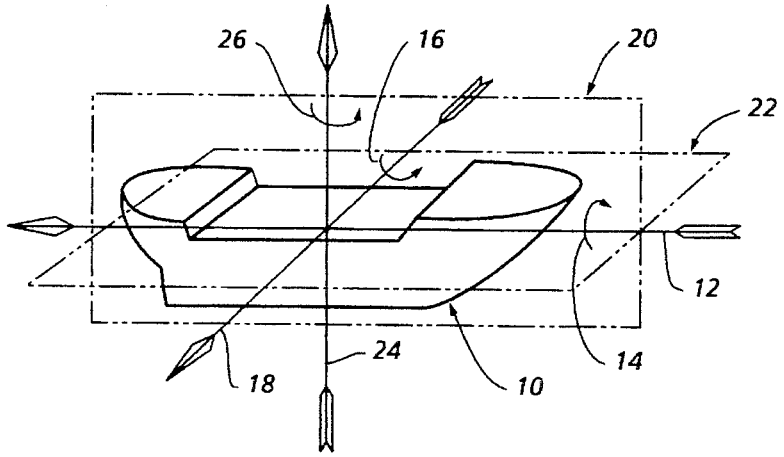
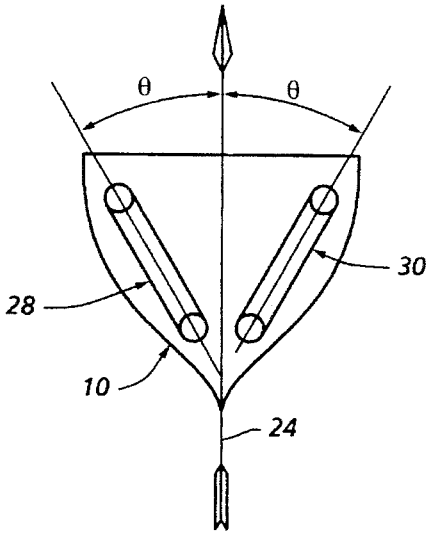
FIG. 2
FIG. 3
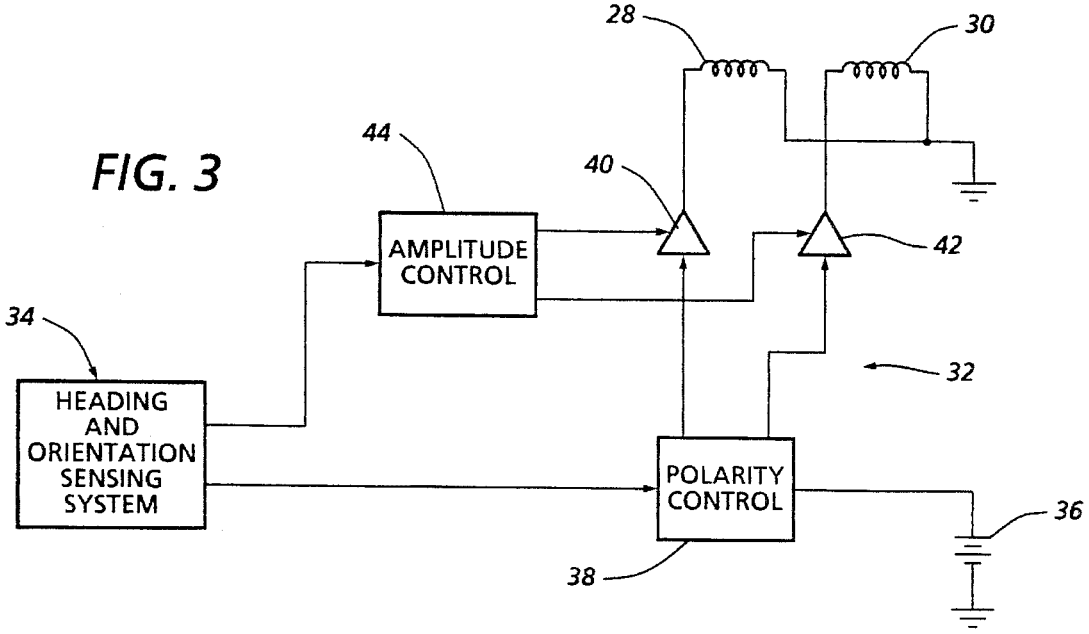

ADVANCED DEGAUSSING COIL SYSTEM

BACKGROUND OF THE INVENTION

This invention relates in general to reducing the static magnetic field signature of marine vessels by use of hull mounted loop coils through which electrical currents are conducted for magnetic degaussing purposes.

The use of hull mounted degaussing coils in an attempt to cancel or reduce static magnetic field signatures of naval vessels to minimize mine detection for example, is already well known in the art as referred to in a related copending application, Ser. No. 08/115,075, filed Sep. 1, 1993 and officially allowed on Jul. 19, 1995. Pursuant to such magnetic degaussing systems, orthogonal sets of degaussing coil loops are respectively aligned in perpendicular planes to reduce magnetization field components, involving what are referred to in the prior art as A-coil, L-coil and M-coil arrangements. Such systems sometimes feature automatic controls for varying current conducted through the degaussing coils in accordance with parameters which affect the vessel's magnetic field signature, such as geometric heading, roll, pitch and yaw. For example, current control for the M-coil loop in a horizontal degaussing plane to compensate for vertical components of a ship's magnetic field is disclosed in each of U.S. Pat. Nos. 2,519,395 and 2,718,205 to Perlow and Febs et al., respectively. The Perlow patent also discloses variation of current in a degaussing coil loop positioned in alignment with a longitudinally extending vertical plane to neutralize transverse magnetization of a vessel in a horizontal plane as a trigometric function of the vessel heading.

It is therefore an important object of the present invention to provide a loop coil degaussing system which is capable of reducing the magnetic field signature of a vessel to levels lower than that possible with existing conventional systems.

A further object of the invention in accordance with the foregoing object is to achieve magnetic field signature reduction with a degaussing coil loop arrangement of reduced cost.

SUMMARY OF THE INVENTION

In accordance with the present invention, the degaussing system for a marine vessel features at least one pair of coil loops mounted adjacent the port and starboard sides of the vessel hull in slanted or non-orthogonal positions at equal angles to a vertical plane extending along the keel or roll axis of the hull. Such slanted coil loops thereby serve magnetic field reducing functions heretofore performed by both A-coil and M-coil loops to obtain a desired reduction in magnetic field signature level.

Achievement of the magnetic field reducing operation is effected by simultaneous variation of electrical currents respectively conducted through the slanted loop coils of each pair in accordance with vessel heading and changes in roll and pitch orientations. In accordance with one embodiment, dc current in the coils of each pair are simultaneously varied from equal amplitudes of opposite polarity, corresponding to compensation for primarily a vertical field magnetization of the vessel.

DESCRIPTION OF THE DRAWING FIGURES

A more complete appreciation of the invention and many of its attendant advantages thereof will be readily appreciated as the same becomes better understood by reference to the following detailed description when considered in connection with the accompanying drawings wherein:

FIG. 1 is a diagrammatic view of a typical marine vessel as the environment for installation and use of the present invention;

FIG. 2 is a diagrammatic transverse section view through the vessel diagrammed in FIG. 1, showing a pair of slanted loop coils mounted therein; and FIG. 3 is a simplified circuit diagram of the degaussing control system associated with the loop coils shown in FIG. 2.

DETAILED DESCRIPTION OF PREFERRED EMBODIMENT

Referring now to the drawing in detail, FIG. 1 diagrammatically illustrates a sea-going vessel generally referred to by reference numeral 10 having a static magnetic field signature dependent on various factors, including the heading of the vessel during sea travel and its orientation. The heading of the vessel is reflected by the geographical direction of its roll axis 12 while orientation will depend on angular displacement 14 about the roll axis as well as angular displacement 16 about a pitch axis 18 in perpendicular intersecting relation to the roll axis 12. As also diagrammed in FIG. 1, the roll and pitch axes lie in a horizontal plane 22. Also, yaw displacement 26 occurs about an axis 24 lying in a vertical plane 20 and intersecting axes 12 and 18 as shown. The vertical and horizontal planes 20 and 22 represent the location of planar components of the magnetic field of the vessel 10, respectively varied in magnitude with changes in pitch about axis 18 and roll about axis 12.

In order to compensate for and reduce the magnetic field of a vessel, a plurality of magnetic field degaussing coil loops are mounted within the hull structure of the vessel to which a source of electrical current is connected under automatic control of some heading and orientation sensing system generally known in the art as referred to in the aforementioned related application, in an effort to significantly reduce or remove the magnetic field signature from which the vessel may otherwise be identified. In accordance with the present invention, at least one pair of degaussing loop coils 28 and 30 mounted in the hull adjacent the port and starboard sides of the vessel 10, as shown in FIG. 2, are angularly positioned relative to planes 20 and 22 at equal angles θ to the vertical plane 20 within which yaw axis 24 lies. The degaussing currents conducted through such non-orthogonal loop coils 28 and 30 are accordingly effective to reduce the magnetic field components of vessel 10 in both the vertical and horizontal planes 20 and 22 with greater efficiency by means of a degaussing current control arrangement 32, as diagrammed in FIG. 3, which includes the heading and orientation sensing system 34 through which all degaussing loop currents were heretofore controlled.

As diagrammatically shown in FIG. 3, degaussing current for the coils 28 and 30 is derived from a dc voltage source 36 through series connected polarity control 38 and a pair of amplifiers 40 and 42 respectively. The dc current amplified outputs of the amplifiers 40 and 42 are regulated by an amplitude control component 44. Signal controlling inputs to the polarity control 38 and amplitude control 44 are derived from the heading and orientation sensing system 34 aforementioned. The dc currents in each pair of coils 28 and 30 are thereby simultaneously varied in amplitude and polarity from equal values of opposite polarity, corresponding to compensation for magnetization primarily in the vertical direction of axis 24. Intermediate values of degaussing current in the port and starboard loop coils 28 and 30, in combiantion with conventional M coils as hereinbefore referred to, will simultaneously produce both vertical and athwartship magnetization to compensate for magnetic field signature components in the vertical and horizontal planes 20 and 22. Such simultaneous variation of degaussing currents in coils 28 and 30 will accordingly enable current control by system 34 to more closely match undergaussed athwartship magnetization of the vessel. The system 34 is so effective through use of a reduced number of loop coils to achieve a specified level of magnetic field signature reduction as compared to existing degaussing systems having both conventional M-coil and A-coil degaussing loops.

In accordance with the present invention, alternative degaussing current control arrangements may include any number of pairs of slanted coil loops on opposite sides of the vessel having their own power supplies or connected in series to a common power supply.

Obviously, numerous other modifications and variations of the present invention are possible in light of the foregoing teachings. It is therefore to be understood that within the scope of the appended claims the invention may be practiced otherwise than as specifically described.

What is claimed is:

1. In a degaussing system for a vessel having port and starboard hull structure mounting loop coils in spaced relation to a longitudinally extending vertical plane, means for simultaneously reducing vertical and horizontal components of a magnetic field signature of the vessel, including at least one pair of said loop coils mounted by the hull structure in angular relation to the vertical plane, a source of voltage, control means operatively connecting said source to said at least one pair of the coils for supply thereto of simultaneously varied degaussing currents and sensing means connected to the control means for determining polarity and amplitude of the simultaneously varied degaussing currents in accordance with heading and orientation of the vessel.

2. The system as defined in claim 1 wherein said at least one pair of the loop coils are respectively positioned by the port and starboard hull structure at equal angles to the vertical plane.

3. The system as defined in claim 2 wherein said degaussing currents are simultaneously varied from equal values of opposite polarity corresponding to maximum degaussing magnetization by said at least one pair of the loop coils.

4. The system as defined in claim 1 wherein said degaussing currents are simultaneously varied from equal values of opposite polarity corresponding to maximum degaussing magnetization by said at least one pair of the loop coils.

5. In combination with magnetic degaussing apparatus including a plurality of loop coils and means for supplying electrical current to said coils varied in accordance with heading and orientation relative to an axis formed at an intersection of perpendicular planes, the improvement residing in at least one pair of said loop coils extending longitudinally along said axis in angular relation to one of said planes, and control means for simultaneously varying the electrical current respectively supplied to the loop coils of said at least one pair from maximum amplitudes of opposite polarity.

6. The apparatus as defined in claim 5 wherein said orientation is roll and pitch of a vessel having a hull within which the loop coils are mounted at equal angles to said one of the planes.

* * * * *